US008087095B2

(12) United States Patent
Maier

(10) Patent No.: US 8,087,095 B2
(45) Date of Patent: Jan. 3, 2012

(54) SPORTS GARMENT, IN PARTICULAR A CYCLIST JERSEY

(75) Inventor: Roger Maier, San Pietro di Stabio (CH)

(73) Assignee: ASSOS of Switzerland S.A. (CH)

( * ) Notice: Subject to any disclaimer, the term of this patent is extended or adjusted under 35 U.S.C. 154(b) by 495 days.

(21) Appl. No.: 11/838,515

(22) Filed: Aug. 14, 2007

(65) Prior Publication Data

US 2008/0047046 A1 Feb. 28, 2008

(30) Foreign Application Priority Data

Aug. 24, 2006 (EP) ..... 06017629

(51) Int. Cl.
*A41D 1/04* (2006.01)
*A41D 27/20* (2006.01)

(52) U.S. Cl. ..... 2/102; 2/248

(58) Field of Classification Search ..... 2/69, 115, 2/94, 247, 248, 102, 49.1, 49.2
See application file for complete search history.

(56) References Cited

U.S. PATENT DOCUMENTS 1,599,687 A * 9/1926 Sullivan ..... 2/247
2,240,902 A * 5/1941 Fishman ..... 2/115
2,248,455 A * 7/1941 Freund ..... 2/94
2,688,752 A * 9/1954 Sbarra et al. ..... 2/113
4,149,272 A * 4/1979 Maeshima ..... 2/102
4,272,852 A * 6/1981 Bell ..... 2/94
4,328,533 A * 5/1982 Paredes ..... 362/108
4,389,735 A * 6/1983 McLaughlin ..... 2/94
4,502,155 A * 3/1985 Itoi ..... 2/115
4,526,298 A * 7/1985 Boxer et al. ..... 222/130
4,544,087 A * 10/1985 Modig ..... 224/148.2
4,564,957 A * 1/1986 Scharf ..... 2/75
4,825,471 A * 5/1989 Jennings ..... 2/94
5,070,436 A * 12/1991 Alexander et al. ..... 362/108
5,247,707 A * 9/1993 Parker et al. ..... 2/102
5,365,614 A * 11/1994 Perkins ..... 2/247
5,487,190 A * 1/1996 Thompson ..... 2/102
5,490,289 A * 2/1996 Lehrer ..... 2/49.2
5,526,969 A * 6/1996 Greenberger ..... 224/153
5,617,582 A * 4/1997 Burwell ..... 2/102
5,640,715 A * 6/1997 Adams ..... 2/46
5,722,573 A * 3/1998 Carnel ..... 224/148.2
D394,338 S * 5/1998 Lacey ..... D2/841
5,774,338 A * 6/1998 Wessling, III ..... 361/730
5,832,536 A * 11/1998 Kramer ..... 2/69
5,860,164 A * 1/1999 Johnson ..... 2/94
5,864,880 A * 2/1999 Adam ..... 2/94
5,893,370 A * 4/1999 Perez et al. ..... 2/94
5,909,802 A * 6/1999 Puco et al. ..... 2/102

(Continued)

FOREIGN PATENT DOCUMENTS

DE 37 32 496 A1 4/1989

(Continued)

*Primary Examiner* — Alissa L Hoey
(74) *Attorney, Agent, or Firm* — Akerman Senterfitt

(57) ABSTRACT

Sports garment (10), especially a cyclist jersey, of the type comprising a vest (12) intended to be in contact with the sportsman's torso and equipped with at least one pocket (14), means (16) being provided for supporting said at least one pocket (14), extended between at least one part thereof and an area of the sports garment positioned substantially at the shoulders of the sportsman who is wearing said garment (10), thus substantially transforming said pocket (14) into a pack-saddle, i.e. into a shoulder bag associated with the said garment (10).

5 Claims, 1 Drawing Sheet

U.S. PATENT DOCUMENTS

| | | | | |
|---|---|---|---|---|
| 6,000,064 | A * | 12/1999 | Alcone et al. | 2/248 |
| 6,035,450 | A * | 3/2000 | Monsen et al. | 2/422 |
| 6,119,270 | A * | 9/2000 | Chou | 2/108 |
| 6,141,798 | A * | 11/2000 | Manning | 2/49.1 |
| 6,216,280 | B1 | 4/2001 | Rabe | |
| 6,240,564 | B1 * | 6/2001 | Te Kanawa | 2/115 |
| 6,260,202 | B1 * | 7/2001 | Villalobos et al. | 2/102 |
| 6,324,697 | B1 * | 12/2001 | Shofner | 2/102 |
| 6,405,378 | B1 * | 6/2002 | Garner | 2/102 |
| 6,516,981 | B2 * | 2/2003 | Perez et al. | 224/148.6 |
| 6,675,391 | B2 * | 1/2004 | Morrison | 2/102 |
| 6,962,277 | B2 * | 11/2005 | Quintana et al. | 224/262 |
| 7,278,171 | B1 * | 10/2007 | Besch | 2/48 |
| 7,490,740 | B2 * | 2/2009 | Robins et al. | 222/175 |
| 7,509,692 | B2 * | 3/2009 | Elkins et al. | 2/458 |
| 7,552,734 | B2 * | 6/2009 | Adams | 128/847 |
| 7,565,705 | B2 * | 7/2009 | Elkins et al. | 2/458 |
| 2001/0052532 | A1 * | 12/2001 | Perez et al. | 224/575 |
| 2002/0100108 | A1 * | 8/2002 | Stuart | 2/247 |
| 2002/0124294 | A1 * | 9/2002 | McKenzie et al. | 2/69 |
| 2007/0294801 | A1 * | 12/2007 | Furgerson et al. | 2/115 |
| 2008/0067202 | A1 * | 3/2008 | Silva et al. | 224/148.2 |
| 2008/0301863 | A1 * | 12/2008 | Goff et al. | 2/467 |
| 2009/0044310 | A1 * | 2/2009 | Baacke | 2/94 |
| 2009/0272773 | A1 * | 11/2009 | Andrade | 224/153 |
| 2010/0122390 | A1 * | 5/2010 | Sender | 2/49.2 |

FOREIGN PATENT DOCUMENTS

| | | | |
|---|---|---|---|
| FR | 2 345 957 | A1 | 10/1977 |

* cited by examiner

SPORTS GARMENT, IN PARTICULAR A CYCLIST JERSEY

FIELD OF APPLICATION

The present invention refers in its broadest aspect to the field of sportswear.

In particular, the invention refers to a garment specially designed and structured to "help" someone tackle, bear and complete a sports practice.

More in particular, the invention refers to a garment of the above-mentioned type, comprising a vest intended to be in contact with the sportsman's torso and equipped with at least one pocket of large dimensions, intended to receive tools, accessories, various devices, luxury goods, etc., all related to the type of activity or sports practice for which said garment has been conceived.

Such garments may include for example jackets, jerseys and waistcoats, specially designed and structured for hunters, fishermen, canoeists, skiers, etc.

Even more in particular, but not exclusively, the invention refers to a cyclist jersey equipped with at least one capacious pocket in its rear part, i.e. the part intended to cover the back of the sportsman wearing it, said pocket transversally extending in respect to the jersey, at the user's "waistline" and being superiorly accessible through special openings provided at an upper end thereof.

In the following part of the description this latter type of sports garment, i.e. a cyclist jersey, will be referred to in no manner limiting the scope of the invention.

PRIOR ART

In the field of sports garments of the type considered, in particular of cyclist jerseys, there is a great need for having at least one pocket of large dimensions, easily accessible, associated with said garments, in order to receive the objects that are used during the activity or sports practice.

And it is known that in general such a pocket is provided on the rear part of the jersey, using the same material of which the jersey considered is made.

No matter how widely and advantageously used for a long time, so-structured cyclist jerseys exhibit a known and serious drawback, never solved until now.

In fact, when it is loaded with accessories, luxury goods, flasks, etc., said pocket "deforms" in a very considerable manner, unavoidably elongating downwards. Furthermore, the weight of the objects contained in the pocket also causes a deformation of the jersey itself.

The pocket and its contents, as well as the jersey itself, may even take "positions" interfering with the cyclist's movements and somehow hamper the cyclist, thus determining extra fatigue and almost always considerable discomfort.

SUMMARY OF THE INVENTION

The technical problem underlying the present invention is to devise and provide a sports garment of the type considered, capable of overcoming, in a simple and effective manner, the limitations and drawbacks of the known art, i.e. capable of ensuring the sportsman an optimal wearability even when the pockets are full.

This problem is solved, according to the present invention, by a sports garment, in particular a cyclist jersey, of the type comprising a vest intended to be in contact with the sportsman's torso and equipped with at least one pocket, characterized in that means are provided for supporting said at least one pocket, extended between at least one part of it and an area of the sports garment positioned substantially at the shoulders of the sportsman who is wearing said garment, thus substantially transforming said pocket into a pack-saddle, i.e. into a shoulder bag associated with the said garment.

Advantageously, the above-said sports garment deforms in an uncommonly limited manner, ensuring an optimal wearability and adherence to the sportsman's torso, regardless of the pockets' content, due to the fact that the weight of the objects contained in the pockets is supported by the above-mentioned means.

Further characteristics and advantages of the sports garment according to the present invention will result from the description below of a preferred embodiment thereof, given as indicative and not limiting purpose with reference to the attached figures.

DETAILED DESCRIPTION OF A PREFERRED EMBODIMENT

Figure 1:
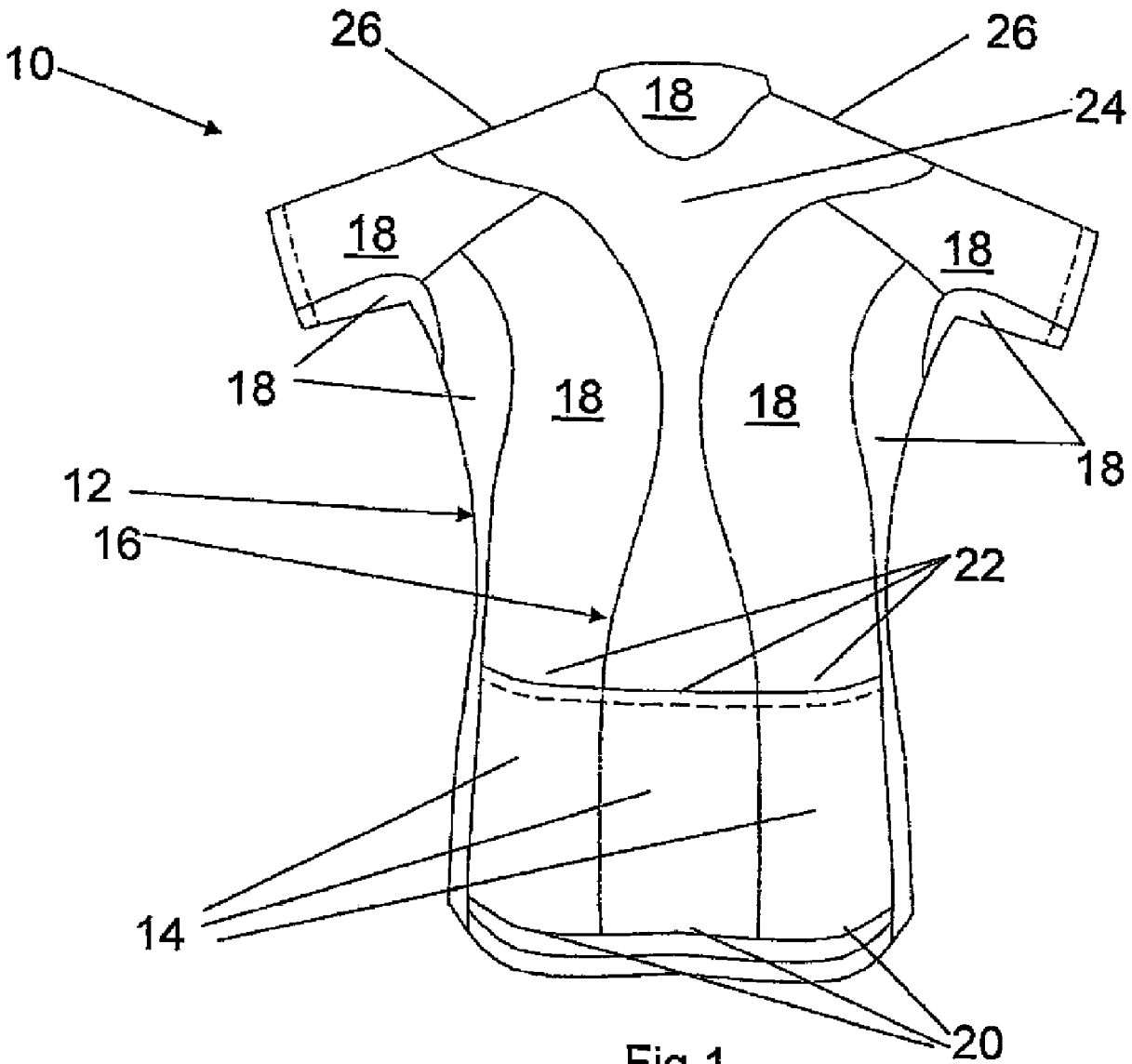
FIG. 1 schematically represents a side elevation view of a sports garment according to the present invention.

Referring to the figures, a sports garment is shown according to the present invention and is globally indicated by 10. In particular, a cyclist jersey is shown.

The above-mentioned sports garment 10 is of the type comprising a vest 12 intended to be in contact with the sportsman's torso and equipped with three pockets 14. In general, the pockets 14 may be at least one and are also of large dimensions.

According to one aspect of the present invention, means 16 for supporting said at least one pocket 14 are provided, extended between at least one part thereof and an area of the sports garment 10 positioned substantially at the shoulders of the sportsman who is wearing said garment. In this way, each pocket 14 is substantially transformed into a pack-saddle, i.e. into a shoulder bag associated with the said garment 10.

In the present patent application, it is to be noted that the expression "substantially at the shoulders" means the upper portion of the sportsman's torso in general, i e. the one that comprises the left shoulder, the neck and the right shoulder.

The vest 12 of the garment 10 comprises a plurality of portions 18 of substantially elastic fabric, mutually perimetrically associated in a per se conventional way.

As an example, the portions 18 are associated through threaded seams, heat-weldings, laser seams, ultrasound seams, or the like.

Furthermore, in general, the portions of fabric 18 are in elasticized material, for example in synthetic elastomeric fiber Lycra®, so as to adhere as much as possible to the cyclist's torso, thus ensuring minimal aerodynamic resistance.

In the non-limiting example of sports garment 10 shown in the FIGURE, i.e. in the case of the cyclist jersey, said three pockets 14 are formed on the rear part of the garment 10, i.e. on the part intended to cover the back of the sportsman who is wearing it, in order to interfere as little as possible with the movements of the cyclist's legs.

The pockets 14 have the lower side closed 20, positioned substantially at the waistline of the cyclist who is wearing said jersey, and are open and accessible at their upper side 22 (or may be easily open at their upper side 22, for example through a slide fastener).

The means 16 for supporting said pockets 14 comprises a portion of fabric 24, having predetermined stiffness greater than that of the remaining portions 18 of fabric and extended between at least one part of said pockets 14 and an area of the sports garment 10 positioned substantially at the shoulders of the cyclist who is wearing said jersey.

In particular, the portion of fabric 24 is centrally positioned on the rear part of the jersey, along the symmetry axis of the jersey itself, and has two upper tracts 26 which end, respectively, on the left shoulder and the right shoulder of the cyclist who is wearing said jersey.

In further embodiments of the invention not represented, the portion of fabric 24 extends also beyond the top of the shoulders, until it reaches the front part of the jersey, possibly surrounding the cyclist's neck.

Advantageously, the portion of fabric 24 is made of a breathing material, to ease the elimination of the sweat. As an example, the portion of fabric 24 is a net-like fabric made of a substantially non-elastic thread, such as a polyester fiber fretworked.

Advantageously and for particular applications, the portion of fabric 24 is an integral part of the pocket or of the pockets 14.

For example, preferably, the portion of fabric 24 extends as far as at the waistline of the cyclist, and on said end a further portion of fabric 18 is applied, externally to the jersey, which forms said pocket or said pocket 14.

Alternatively, the portion of fabric 24 extends beyond the waistline of the cyclist, and is folded on itself, externally to the jersey, at the waistline itself, until it forms said pocket or said pockets 14.

Of course, in the cycling field, the invention may be applied not only to the jerseys (short- or long-sleeved), but also to the jackets (short- or long-sleeved) and the body including trousers (short, long or tight-like) and vest (short- or long-sleeved).

From the above description, it is obvious that the sports garment according to the invention solves the technical problem and achieves numerous advantages, the first of which lies is that it deforms in an uncommonly limited manner, ensuring an optimal wearability, regardless of the extent to which the pockets are full.

Furthermore, in this way, the garment keeps an optimal adherence to the sportsman's torso, avoiding causing him discomfort or even impediment during the sports activity.

In particular, the garment does not elongate, and remains in the correct position with respect to the sportsman's body: in the case of the cyclist jersey, also when the pockets are full, it does not "wring" at the cyclist's waistline, and the pockets do not tend to move towards the front of the jersey, as occurs in jerseys of the prior art.

It should not be forgotten, especially in the case of the cyclist jersey, that the good adherence of the jersey also ensures the minimum aerodynamic resistance, and therefore lesser fatigue.

A further advantage of the sports garment according to the invention is that its ergonomics is improved, i.e. great freedom of movement and comfort are ensured in that the garment remains "stable" in its correct position and adheres well to the sportsman's torso.

Of course, a man skilled in the art can make numerous modifications and variants to the above-described sports garment in order to satisfy contingent and specific requirements, all of which are in any case covered by the scope of protection of the present invention as defined by the following claims.

The invention claimed is:

1. A cyclist jersey comprising:

a plurality of elastic fabric portions; and a fabric portion having a stiffness greater than that of the elastic fabric portions, wherein the plurality of elastic fabric portions and the stiffer fabric portion are connected together at their perimeters to form a vest, and wherein the stiffer fabric portion is arranged between at least some of said plurality of elastic fabric portions to form a shoulder strap embedded in the structure of the vest, the shoulder strap being a support of a shoulder bag forming a pocket, the stiffer fabric portion of the shoulder strap extending from the shoulder area of the rear part of the jersey to beyond the waistline of the jersey and being folded back on itself, externally to the jersey at the waistline, to form said pocket, with other areas of the vest being formed in general by said elastic fabric portions so as to adhere to the cyclist's torso to create minimal aerodynamic resistance when worn.

2. The cyclist jersey according to claim 1, wherein said shoulder strap is centrally positioned on the rear part of said jersey, along a symmetry axis of the jersey itself, and wherein said shoulder strap has two upper tracts ending respectively on the left shoulder and the right shoulder portions of the vest.

3. The cyclist jersey according to claim 1, wherein said shoulder strap is centrally positioned on the rear part of said jersey, along a symmetry axis of the jersey itself, and wherein said shoulder strap has two upper tracts extending beyond shoulder portions of the jersey, reaching the front part thereof.

4. The cyclist jersey according to claim 1, wherein said shoulder strap is made of a breathable material.

5. The cyclist jersey according to claim 1, said shoulder strap comprising:

a net-like fabric mesh that is positioned between at least two of said elastic fabric portions, said fabric mesh formed of a substantially non-elastic thread and having a stiffness greater than that of said elastic fabric portions, and said fabric mesh extending between at least one part of said shoulder bag and an area of the jersey positioned substantially at the shoulder of the wearer, to support said shoulder bag.

* * * * *